US005255611A

United States Patent [19]

Schneider

[11] Patent Number: 5,255,611

[45] Date of Patent: Oct. 26, 1993

[54] TILT COMPENSATOR FOR HIGH-SPEED VEHICLES, IN PARTICULAR RAIL VEHICLES

[75] Inventor: Richard Schneider, Neuhausen am Rheinfall, Switzerland

[73] Assignee: SIG Schweizerische Industrie-Gesellschaft, Switzerland

[21] Appl. No.: 926,162

[22] Filed: Aug. 5, 1992

Related U.S. Application Data

[62] Division of Ser. No. 536,689, Jul. 13, 1990, Pat. No. 5,222,440.

[30] Foreign Application Priority Data

Oct. 13, 1988 [CH] Switzerland ..... 3832/88

[51] Int. Cl.[5] ..... B61F 5/00

[52] U.S. Cl. ..... 105/199.2; 105/453

[58] Field of Search ..... 105/199.1, 199.2, 164, 105/194, 209, 167

[56] References Cited

U.S. PATENT DOCUMENTS

| | | | |
|---|---|---|---|
| 3,717,104 | 2/1973 | Law et al. | 105/199.2 |
| 3,818,841 | 6/1974 | Julien | 105/199.2 |
| 3,977,694 | 8/1976 | Nordstrom | 105/199.2 |
| 4,324,187 | 4/1982 | Sambo | 105/164 |
| 4,363,277 | 12/1982 | Martin et al. | 105/164 |
| 4,516,507 | 5/1985 | Dean | 105/199.2 |

FOREIGN PATENT DOCUMENTS

| | | | |
|---|---|---|---|
| 1077781 | 5/1980 | Canada | 105/199.2 |
| 0128126 | 12/1984 | European Pat. Off. . | |
| 2129716 | 12/1971 | Fed. Rep. of Germany | 105/199.2 |
| 2246881 | 4/1974 | Fed. Rep. of Germany . | |
| 2434143 | 2/1975 | Fed. Rep. of Germany . | |
| 2512008 | 10/1975 | Fed. Rep. of Germany . | |
| 3311989 | 7/1988 | Fed. Rep. of Germany . | |
| 0978764 | 4/1951 | France | 105/199.2 |

*Primary Examiner*—Mark T. Le
*Attorney, Agent, or Firm*—Ostrolenk, Faber, Gerb & Soffen

[57] ABSTRACT

A device for compensating the tilt of the carriage body of a rail vehicle when travelling around sharp turns at high speeds includes a tilt compensator with a four-bar mechanism, the tilt compensator being operationally connected to an energy storage device. The four-bar mechanism includes a transversely movable support that is mounted in a floating manner and which is supported on a carriage body suspension for providing vertical cushioning of the carriage body. Preferably, the four-bar mechanism is formed of a wobble stabilizer, two laterally mounted hinged supports and the aforementioned transverse support mounted in a floating manner with a central pivot extending between the energy store and the transverse support.

14 Claims, 8 Drawing Sheets

TILT COMPENSATOR FOR HIGH-SPEED VEHICLES, IN PARTICULAR RAIL VEHICLES

This is a division of application Ser. No. 07/536,689, filed Jul. 13, 1990, now U.S. Pat. No. 5,222,440.

BACKGROUND OF THE INVENTION

The present invention relates to a device for compensating the tilt of the carriage body of a rail vehicle when travelling around bends at high speeds, and for reducing the centrifugal forces arising therefrom in order to keep the stresses for the passengers within such limits as provide comfortable travel.

The general strivings to increase the travel speed in rail traffic go hand in hand with the problem of being able to retain high speeds, unrestricted, even in the bends.

Current track apparatus has certain superelevations in order to be able to compensate the effect of centrifugal force during travel on bends. These superelevations are only able, however, to compensate the centrifugal forces as a function of the radius of curvature up to a certain speed.

Furthermore, speeds simultaneously increase the forces acting laterally relative to the direction of travel, which then have an unpleasant effect on the passengers during travel on bends.

A rail vehicle travelling thus with excess centrifugal force on a bend with a superelevated track tends to tilt its carriage body towards the outside of the bend.

This situation is undesirable, however, as angular positions oriented in the wrong direction are imposed on the system.

The result is a substantial loss of comfort for the passengers and inadmissible exceeding of the specified clear space profile in a carriage body cross-section which is not specially adapted.

In this sense it is necessary so to compensate such a tilt of the carriage body towards the outside of the bend that, at the same time, the excessive centrifugal force acting on the passengers is reduced.

This means imposing on the carriage body of a rail vehicle a tilt oriented towards the inside of the bend in order to effect increased speeds on bends.

In the prior art, two modes of operation have been used to this end: either an active tilt system, e.g. according to DE-OS 24 34 143, wherein the carriage body of a rail vehicle is tilted towards the inside of the bend at a proportional angle and about a horizontal longitudinal axis by means of control and adjustment elements, or a passive tilt system, e.g. according to DE-OS 25 12 008, wherein the carriage body of a rail vehicle is mounted so as to oscillate like a pendulum and the longitudinal axis of the tilting movement oriented towards the inside of the bend in each case lies above the center of gravity of the vehicle.

Both above-mentioned modes of operation have in common the disadvantage, however, that a special cross-section of the carriage body is produced, which is different for each system, depending on the height of their respective center of rotation.

Whereas in an active system, although all possible compensation of the tilt angle can be achieved, it is at the cost of very high investment in control and mechanics.

In a passive system, on the other hand, the expense involved is substantially less, but at the same time the corresponding compensation of the angle of tilt is more modest.

SUMMARY OF THE INVENTION

Therefore, the present invention aims to combine the advantages of the two above-mentioned systems and additionally to eliminate the disadvantage of a special carriage body cross-section associated with both solutions.

This is achieved by a passive system wherein, with a tilt compensator in the form of a four-bar mechanism, the thrust of the carriage body to tilt to the outside of the bend is compensated and, supported by an energy store, is converted into a tilt of the carriage body towards the inside of the bend.

In this case, the solution according to the invention uses elements known per se, but with the aim of overcoming therewith the parasitic rigidities of the system, which by the kinetics of the four-bar mechanism make the prescribed tilt of the carriage body towards the inside of the bend difficult.

Two transverse air springs connected together in an intercommunicating manner and mounted horizontally in pairs opposite one another between the bogie and the carriage body act as an energy store, which due to their negative rigidity behave flexibly per se. Between them and the rest of the system the energy stored in the transverse air springs is thus displaced to and fro in a unique manner, i.e. is exchanged, but not supplied from outside, in order to overcome the parasitic resistance to tilting of the carriage body towards the inside of the bend.

From EP-0 128 126, air springs mounted in pairs horizontally between the bogie and the carriage body are already known, which are intended, however, essentially to damp the horizontal forces and with which the carriage body can be guided by a control pulse via the bogie in the direction of a bend-dependent transverse play limitation, and otherwise centrally.

In the solution according to the invention, on the other hand, essentially by varying the rigidity of the pair of transverse air springs, the angle of inclination of the carriage body towards the inside of the bend is varied over relatively large ranges, which can only be effected otherwise with an active tilting system.

To achieve good transverse comfort, even when the heights of the centers of rotation are too low or when the centrifugal force tilt is not exploited, the tilt compensator can be supported by further additional transverse springs, which are mounted in series to the carriage body suspension system proper.

If the transverse air springs are used for energy exchange and for damping the tilting movement, particular embodiments permit alternately or cumulatively an integrated longitudinal locking and vertical emergency support/safeguarding against lifting and speed-dependent carriage body transverse play limitation during travel on bends.

By this multi-functional formation of the transverse air springs, the solution is clearly differentiated, even in detail, from the prior art shown in DE-OS 22 46 881, where comparable functions are only achieved by very expensive devices.

At the same time, the present solution permits a placing of the level regulating lever system of the vertical carriage body suspension in such a manner that, neither under the influence of the carriage body tilt nor in the case of any transverse movements, nor due to a bogie swing during travel on bends, does a tilted position of the alignment rod result, and thus an expensive arrangement according to DE-PS 33 11 989 known from the prior art can be avoided.

BRIEF DESCRIPTION OF THE DRAWINGS

Preferred embodiments of the invention are explained in detail below with the aid of a drawing, in which.

DETAILED DESCRIPTION

Figure 1:
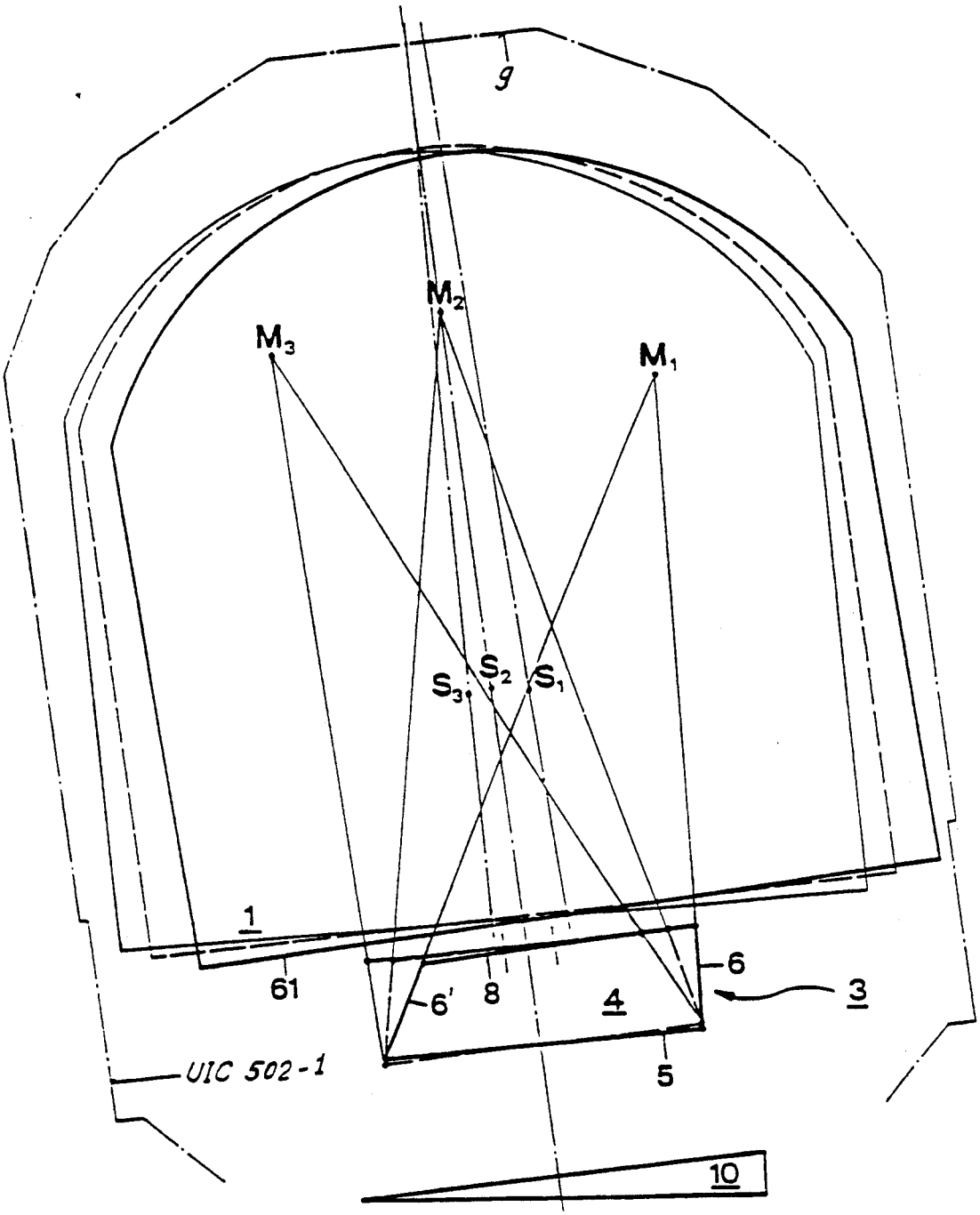
FIG. 1 is a diagrammatic illustration of a vehicle crosssection with tilt compensation in the superelevated track.

FIG. 1 shows the diagrammatic illustration of a rail vehicle in the superelevated track bend 10, reduced to the essential elements.

In this case, a carriage body 1 is guided by means of a tilt compensator 3 on a bogie which is not shown. The tilt compensator 3 prevents tilting of the carriage body 1 towards the outside of the bend in the superelevated track 10 and operates substantially in combination with a four-bar mechanism 4. This is formed of a wobble stabilizer 5 fixed to the bogie frame with the two laterally mounted hinged supports 6, 6' and a transverse support 8 mounted in a floating manner.

The diagrammatic illustration comprises the three following travel states:

in bold lines, the position of a vehicle with tilt compensation in the superelevated track in the case of a transverse acceleration of, for example, 1.8 $m/S^2$ in dot-dash lines, the same vehicle, but assuming all mobile elements to be rigid in thin lines, the same vehicle in the superelevated track when stationary and with the inclination drive towards the inside of the bend.

For the sake of clarity, some elements, which do cooperate in the respectively described form, are illustrated in detail in separate Figures.

Figure 7:
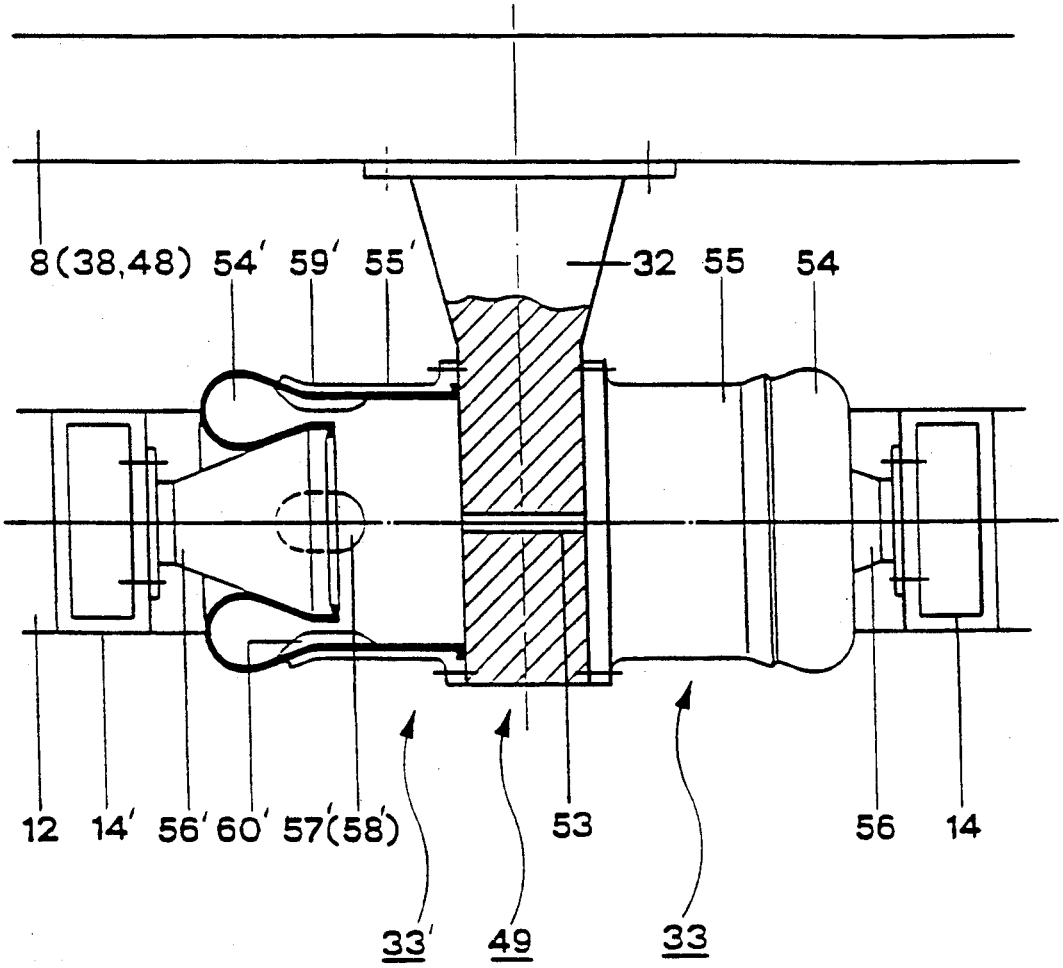
FIG. 7, a detailed illustration of the transverse air suspension in part section.

With the tilt compensator 3, during travel on bends, tilting of the carriage body 1 towards the outside of the bend is compensated in that the hinged support 6 on the outside of the bend, preferably supported by a pair of transverse air springs 33, 33' having a negative rigidity and acting as an energy store 49, as described in FIG. 7, stands up and imposes a horizontally aligned rotary movement on the floating transverse support 8.

In this case, a momentary center $M_1$ to $M_3$ is produced in the points of intersection of the operating lines of the two hinged rods 6, 6', about which momentary center the carriage body 1 is inclined towards the inside of the bend in its longitudinal axis. A center of gravity $S_1$ to $S_3$ in this case undergoes a slight horizontal displacement.

Under the two extreme conditions according to the positions $M_1$ and $M_3$ the carriage body 1, which has a normal crosssection for UIC standardized vehicles and which is preferably equipped with a speed-dependent transverse play limitation device, complies to an internationally prescribed outline profile 9.

Essential to the invention is the fact that a vehicle equipped with a tilt compensator 3 has a passive tilting system, with which the tilt angle of the carriage body (1) towards the inside of the bend assumes comparable values to those which are otherwise only achievable with an active tilting system.

Figure 2:
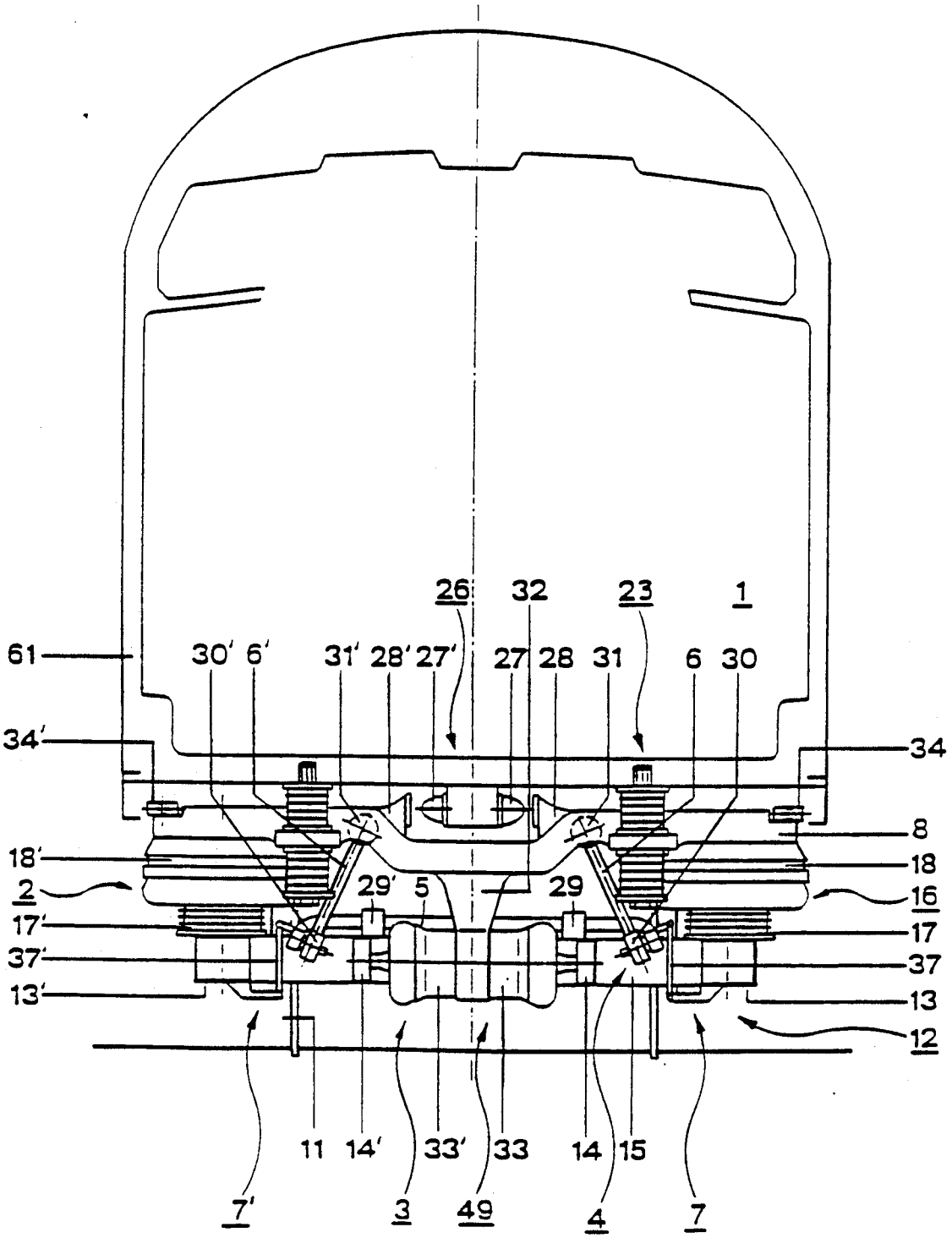
FIG. 2 a cross-section through a further vehicle with a tilt compensator, with an energy store in the form of a transverse air suspension.

In an embodiment shown in FIG. 2, a bogie frame 12 is supported in a known manner with the means of axial guiding and suspension on two wheel sets 11 which are also known. On each of the two longitudinal supports 13, 13' of the bogie frame 12, a carriage body suspension 16 for the vertical spring suspension of the carriage body 1 is mounted in a known manner.

Figure 3:
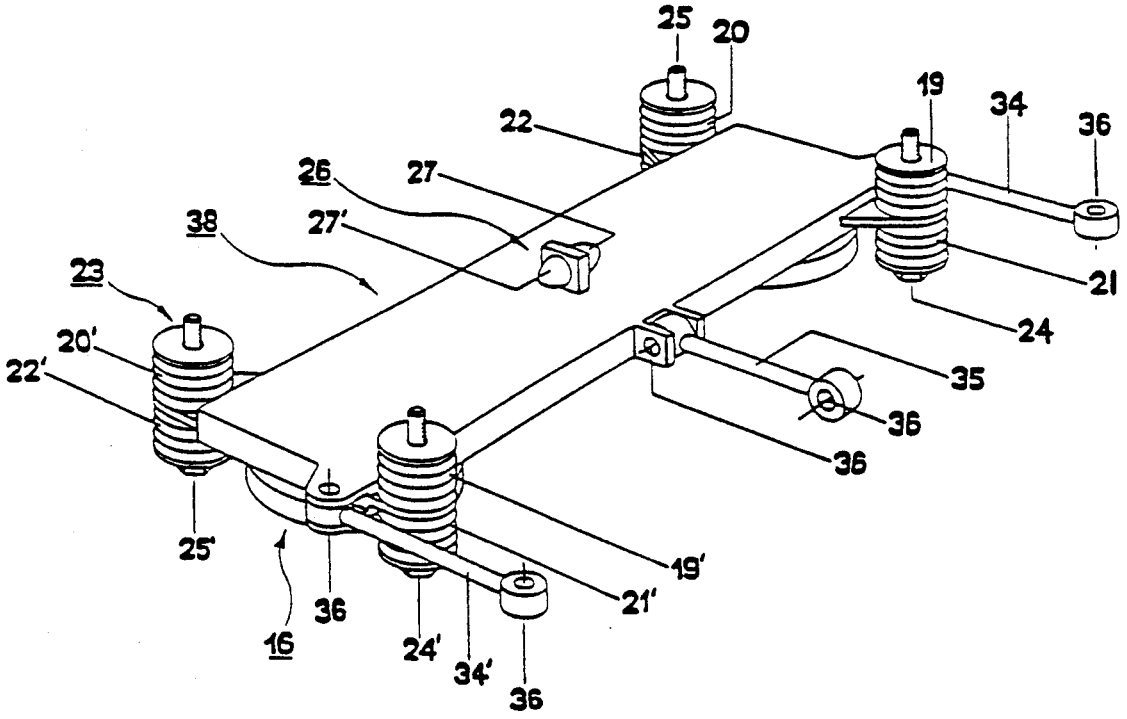
FIG. 3, a perspective view of a floating transverse support.

This consists of a combination, known per se, of an air spring 18, 18' and an emergency spring 17, 17' mounted below the latter, which may be formed as a rubber layer spring. A transverse support 8, mounted in a floating manner, rests on the carriage body suspension 16, between the latter and an additional transverse suspension 23 connected in series thereto. For this, additional transverse springs, such as described under FIG. 3, are braced together in pairs and thus carry the carriage body 1.

The additional transverse suspension 23 connected (connection not shown) in series to the carriage body suspension 16 permits turning out of the carriage body 1 over the bogie 2 due to travel on bends. In particular, the purpose of the additional transverse suspension 23 is to achieve high levels of travel comfort in the transverse direction. Therefore, the transverse rigidity of this suspension is preferably so adjusted that the transverse rigidity of the whole system reduced to the point of gravity of the carriage body assumes an optimum value for the travel comfort in the transverse direction, e.g. 0.5 Hz. To this end, the characteristic curve of the additional transverse suspension 23 can be chosen to be linear, progressive or regressive according to the respective requirements.

A resilient transverse stop 26, consisting of two transverse buffers 27, 27' is located on the carriage body 1, for example, to limit the transverse spring path, whereas the associated stop faces 28, 28' are mounted on the floating transverse support 8. Furthermore, the floating transverse support 8 is connected to the carriage body 1 with longitudinal control arms 34, 34', as is described under FIG. 3. Towards the bottom, the floating transverse support 8 is connected to the bogie frame 12 in the form of a fourbar mechanism 4. This is formed of a wobble stabilizer 5 mounted on the transverse support 15 of the bogie frame 12 in two horizontal rotary bearings 29, 29' and of the two hinged supports 6 and 6' fixed to the ends of said wobble stabilizer in a respective hinge 30, 30'.

The hinged supports 6 and 6' are inclined convergently towards the top and are so fixed to the floating transverse support 8 in the hinge points 31, 31' that they impose on said transverse support a horizontally oriented rotary movement in the case of transverse movement.

Furthermore, the floating transverse support 8 has a central, downwardly oriented pivot 32, which engages between two horizontally mounted transverse air springs 33, 33', which in turn bear against two auxiliary longitudinal supports 14, 14' in the transverse direction.

The four-bar mechanism 4 described above, together with the pivot 32 and the two transverse air springs 33, 33' acting as an energy store 49, forms the tilt compensator 3, which in the case of fast travel on bends produces tilting of the carriage body 1 towards the inside of the bend, but which otherwise permits the vertical cushioning of the carriage body suspension 16.

In this case, in a further example of application, the four-bar mechanism 4 can also be mounted in pairs, so that two wobble stabilizers are used simultaneously, which are again connected to the floating transverse support 8 in a manner indicated, by means of two hinged supports in each case.

Furthermore, between the wobble stabilizer 5 and the bogie frame 12, a respective level regulating lever system 7, 7' is mounted for controlling the air springs 18, 18' of the carriage body suspension 16. This arrangement permits a level regulating lever system of the simplest form to be used, since its alignment rod 37, 37' is not subject to any influences of the carriage body tilt or of any transverse and turning out movements of the bogie 2 during travel on bends.

FIG. 3 shows a further embodiment of a floating transverse support 38. This rests on its under-side on the indicated carriage body suspension 16 and is connected to the carriage body 1 located above it, but not shown, via an additional transverse suspension 23. For this, the additional transverse springs 19 and 21, 20 and 22, as well as 19' and 21', 20', and 22' are braced together in respective pairs with the fixing screws 24, 25 and 24', 25', in order to be able to absorb any moment arising from longitudinal impacts.

To limit the transverse spring path, a resilient transverse stop 26 is provided, consisting of two transverse buffers 27, 27', e.g. on the floating transverse support 38, whereas the stop faces not shown are associated with the carriage body. The coupling of the floating transverse support 38 is effected by longitudinal control arms, which permit movement of the floating transverse support 38 in the vertical and transverse directions, but which lock in the longitudinal direction. To this end, either two longitudinal control arms 34, 34' are mounted in hinge bearings 36 on the outside of the floating transverse support 38, or a central longitudinal control arm 35 is fixed in the center of the floating transverse support 38 via a hinge bearing 36, and its respective other end is connected to the carriage body 1 via hinge bearings 36.

In the arrangement with a central longitudinal control arm 35 the turning out movement between the bogie 2 and the carriage body 1 resulting from the travel on bends is also taken by the additional transverse suspension 23.

Figure 4:
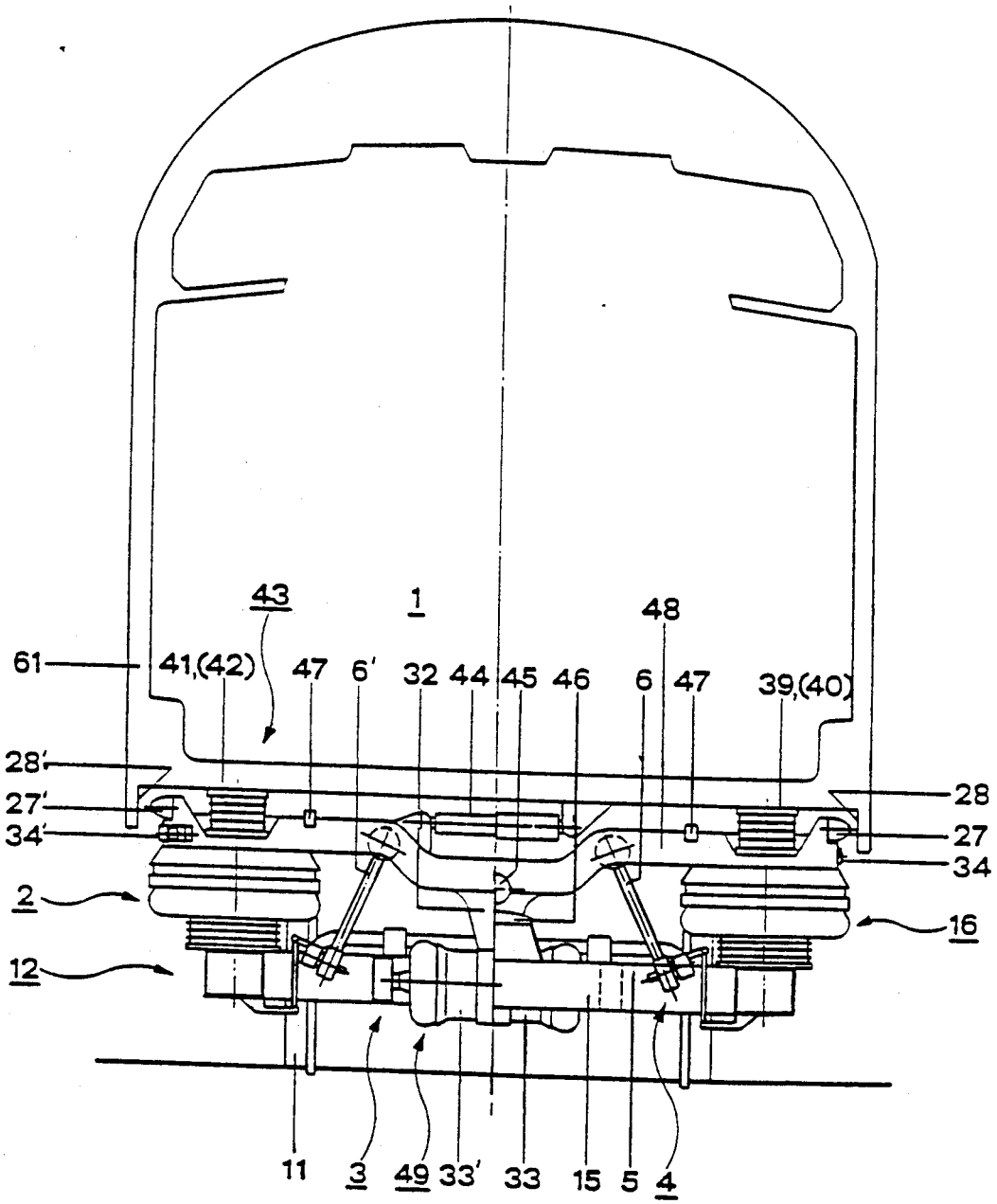
FIG. 4, a cross-section according to FIG. 2, but with a variant of the floating transverse support.
Figure 5:
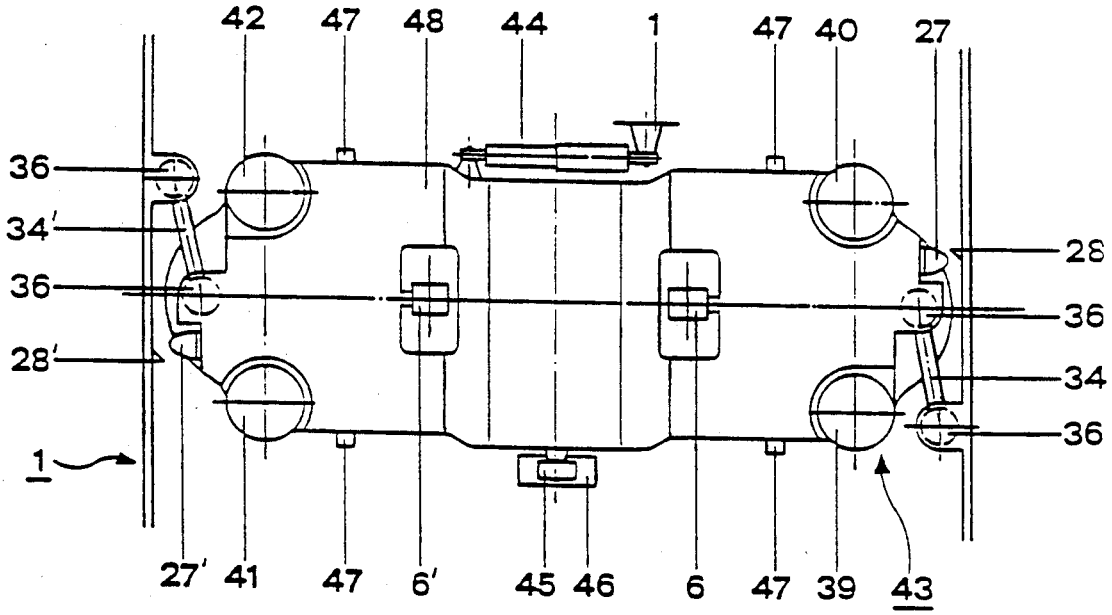
FIG. 5, a plan view of a floating transverse support according to FIG. 4.

FIGS. 4 and 5 show a further preferred embodiment of the invention. In this case, a carriage body 1 is supported on a bogie 2 equipped with a tilt compensator 3. The tilt compensator 3 consists of the four-bar mechanism 4 formed by the wobble stabilizer 5 with the hinged supports 6, 6' and a floating transverse support 48, supported by the two transverse air springs 33, 33' acting as an energy store 49, between which a pivot 32 projects.

The floating transverse support 48 in this case rests between the vertical carriage body suspension 16 and the simplified form of an additional transverse suspension 43, which consists of four additional transverse springs 39, 40, 41, 42 inserted into the floating transverse support 48.

The limiting of the transverse spring path is effected by a respective transverse buffer 27, 27' provided in a rotationally symmetrical arrangement on the side of the floating transverse support 48, the carriage body 1 having the corresponding contact faces 28, 28'.

The coupling of the floating transverse support 48 is effected, for example by two longitudinal control arms 34, 34' lying on the outside in a rotationally symmetrical arrangement, and which permit movement of the transverse support 48 in the vertical and transverse directions, but which lock in the longitudinal direction. To this end, the two longitudinal control arms 34, 34' connect the floating transverse support 48 to the carriage body 1 via respective hinge bearings 36.

The damping of the horizontal oscillations between the floating transverse support 48 and the carriage body 1 can either be effected by a suitable material quality of the spring elements 39, 40, 41, 42 of the additional transverse suspension 43, or by a hydraulic damper 44 mounted between the floating transverse support 48 and the carriage body 1.

In the case of travel on bends with pressure-less operation of the transverse air springs 33, 33' as the result of a defect, the pairing of at least one roller 45 mounted centrally on the floating transverse support 48 with a stop 46, which by its formation determines the transverse characteristic, ensures a passive tilt of the carriage body 1 even under these conditions.

Furthermore, this pairing also has the function of longitudinal eccentric emergency support of the carriage body 1 in the case of travel on bends with pressure-less operation of the air springs 18, 18' of the carriage body suspension 16.

In this case, the pairing of roller 45 and stop 46 can neutralize the wheel load changes caused by the system during operation of the emergency springs 17, 17' in such a manner that the derailing resistance of the leading wheel on the outside of the bend in each case is increased in the advancing bogie.

Unless provided in the transverse air springs 33, 33', as is described under FIG. 7, four devices 47 to safeguard against lifting can be mounted on the floating transverse support 48, and prevent tilting of the transverse support 48 relative to parts of the carriage body 1 in the case of relatively large longitudinal impacts, but without limiting its transverse movement.

Figure 6:
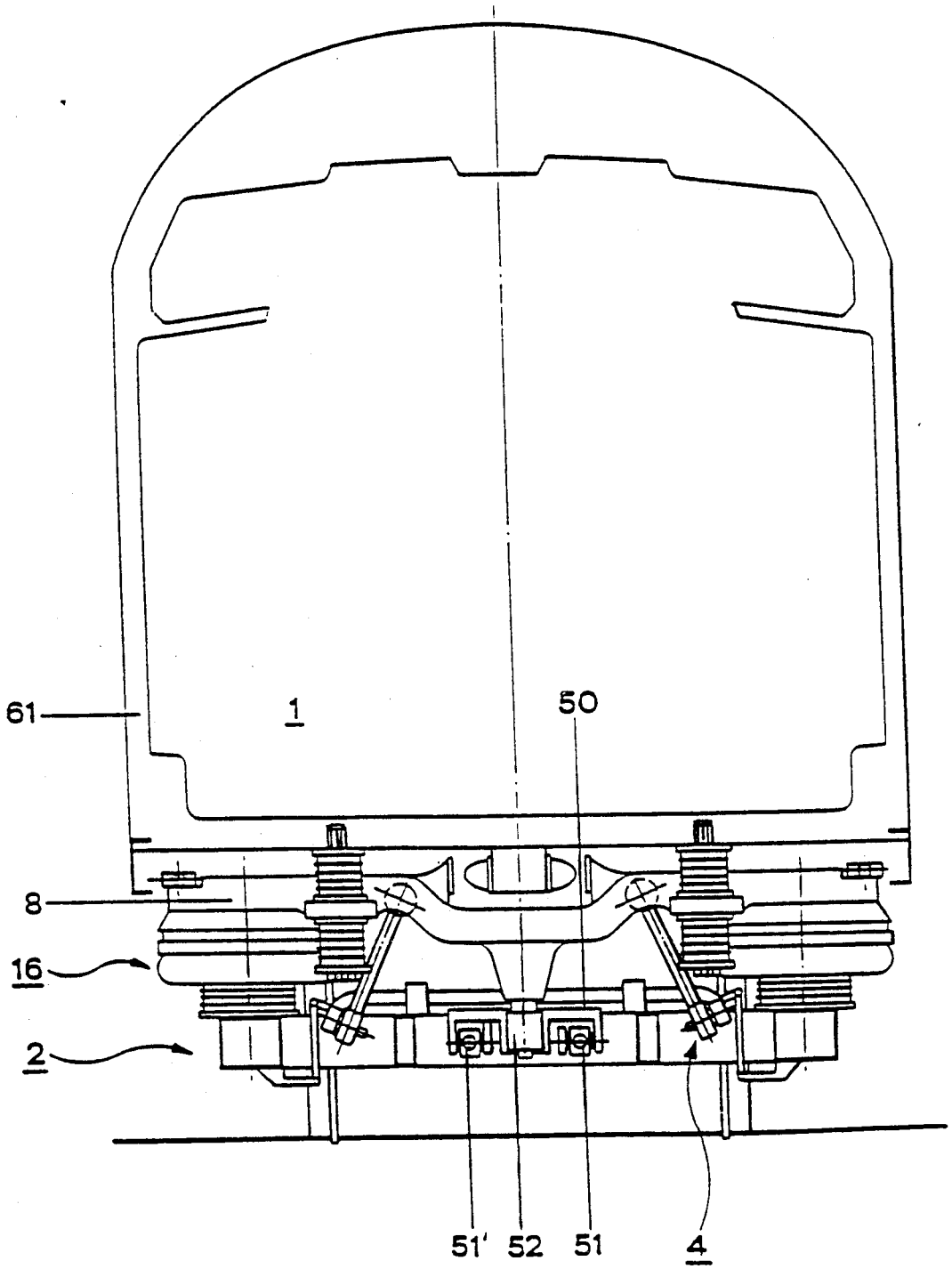
FIG. 6, a cross-section according to FIG. 2, but without transverse air suspension.

An example of application shown in FIG. 6 is substantially identical to the embodiment described under FIG. 2, but consciously omits in this case the energy store 49 supporting the four-bar mechanism 4. In this case, the supporting effect must be provided by the vertical carriage body suspension 16, which to this end has a negative transverse rigidity.

Otherwise, the floating transverse support 8 has a pivot 52, which effects the longitudinal locking between the bogie 2 and carriage body 1 in a known manner by means of two steering rods 51, 51' via a lemniscate yoke 50.

This example of application is intended to show that known bogie constructions can be converted at any time to tilt compensation according to the invention at relatively low cost.

This is also favored particularly by the fact that, in the use of the tilt compensator 3 for existing vehicles, the carriage body contour 61 poses no limitations caused by transverse tilting.

FIG. 7 shows the detailed illustration of the above-mentioned energy store 49 in the form of two transverse air springs 33, 33', which are unstable per se and which are mounted if possible in the bogie pitch center. These are mounted in pairs opposite one another between the pivot 32 projecting down from a floating transverse support 8, 38, 48 and the two auxiliary longitudinal supports 14, 14' of the bogie frame 12.

The two transverse air springs 33, 33' support the tilt of the carriage body towards the inside of the bend produced by the kinetics of the four-bar mechanism 4 during travel on bends. To this end the two transverse air springs 33, 33' have a negative rigidity and help, as an energy store 49, to overcome the parasitic rigidities of the rest of the system by transmitting energy to the rest of the system for the purposes of the tilting process.

By varying the rigidity of the two transverse air springs 33, 33', in interplay with the four-bar mechanism 4, the tilt angle of the carriage body 1 towards the inside of the bend can be varied over comparatively wide ranges, as is only possible otherwise with an active tilting system. To this end the two transverse air springs 33, 33' are preferably connected together in an intercommunicating manner via a choke diaphragm 53 acting as a damper, so that a horizontal damper 44 can be omitted.

Each transverse air spring 33, 33' has a rolling bellows 54, 54', which is mounted between an outer guide 55, 55' fixed to the pivot 32 and a cone 56, 56' fixed to the auxiliary longitudinal support 14, 14' of the bogie frame 12 in the form shown.

With this arrangement, a change of the active surface of the transverse air springs 33, 33' can be achieved via the shaping of the cone 56, 56' and of the outer guide 55, 55'.

Thereby, and by the diameter, which is active in a variable manner in each case and which is produced when the rolling bellows 54, 54' rolls away due to transverse movement, the rigidity of the energy store 49 can be varied.

A variation of the rigidity of the energy store 49 can also be effected via the internal pressure of the two transverse air springs 33, 33', which to this end are connected either directly or via appropriate additional valves to the vertical carriage body suspension 16 and are controlled preferably in a load-dependent manner.

Particular embodiments permit the transverse air springs 33, 33' to become a multi-functional element and permit either alternately or cumulatively an integrated longitudinal locking, a vertical emergency support-/safeguarding against lifting and a speed-dependent transverse play limitation of the carriage body 1 during travel on bends.

For integrated longitudinal locking between bogie 2 and carriage body 1, the rolling bellows 54, 54' of the two transverse air springs 33, 33' have on their inside, horizontally opposite one another, locking faces 57, 57' and 58, 58' covering the region of the largest diameter of the cones 56, 56'.

In this case, the free longitudinal play and the necessary rigidities in the longitudinal direction can be achieved either by appropriate formation of the locking faces 57, 57' and 58, 58' with rubber or plastics cushions, and/or by a purposeful shaping of the respective region on the outer guides 55, 55'.

For integrated emergency support/safeguarding against lifting between carriage body 1 and bogie 2, the rolling bellows 54, 54' of the two transverse air springs 33, 33' have on their inside, vertically opposite one another, stop faces 59, 59' and 60, 60' covering the region of the largest diameter of the cones 56, 56'.

In this case, the stop faces 59, 59' and 60, 60' can also be varied either by appropriate formation with rubber or plastics cushions, and/or by a purposeful shaping of the respective region on the outer guides 55, 55'.

In the case of catches and stops lying opposite one another, in each case offset by 90° for the integrated longitudinal locking and integrated emergency support-/safeguarding against lifting, advantageously a suitably oval outer guide 55, 55' is produced.

Figure 8:
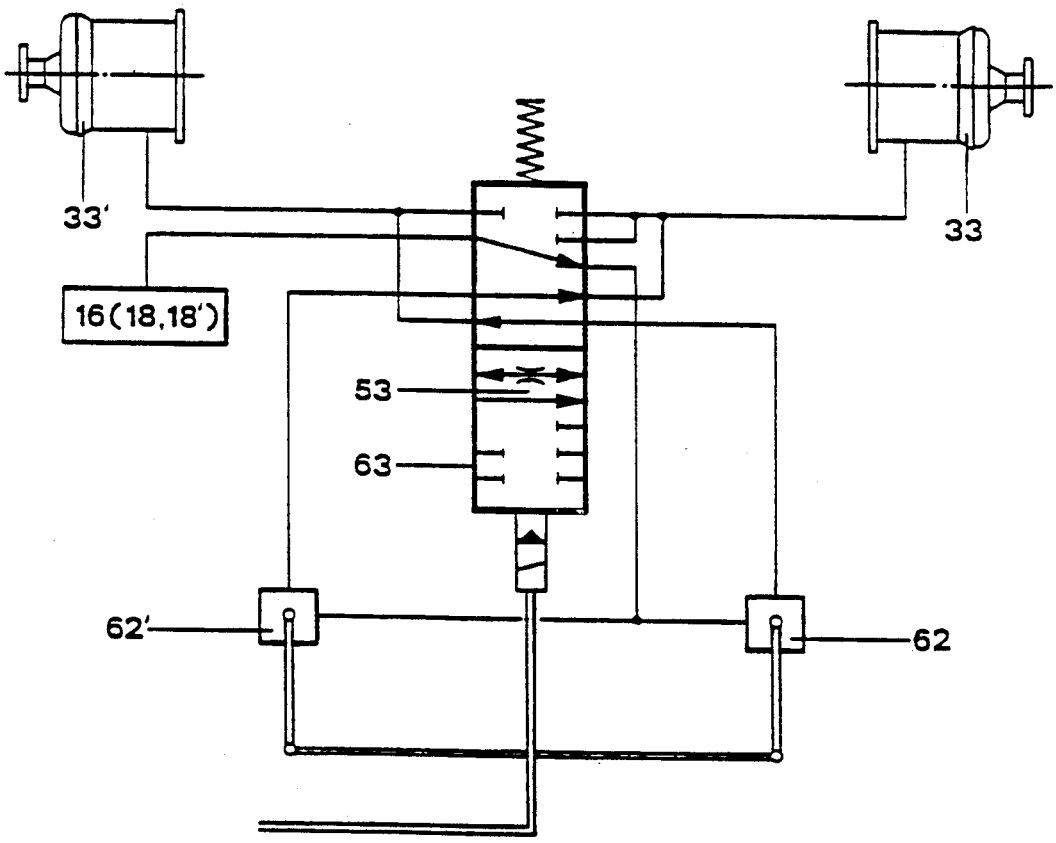
FIG. 8, is a circuit diagram of the transverse air suspension of a tilt compensator for the speed-dependent transverse play limitation of a carriage body during travel on bends.

An integrated speed-dependent transverse play limitation of the carriage body 1 in travel on bends can be achieved as described under FIG. 8. In this case, the transverse air springs 33, 33' are so influenced that the carriage body 1 complies with the different conditions of a bend-dependent transverse play limitation towards the inside of the bend and the outside of the bend as necessary.

FIG. 8 shows a circuit diagram for the speed-related transverse play limitation of a carriage body 1 during travel on bends, wherein the two transverse air springs 33, 33' are controlled via a change-over valve 63 operating in a speed-dependent manner.

The lower position shown of the change-over valve 63 corresponds to its idle state of slow travel on bends up to approx. 40 km/h, wherein the two transverse air springs 33, 33' are connected in a crossed manner to the two position valves 62, 62' monitoring the transverse path of the floating transverse support 8, 38, 48. In this case, the energy store 49 is cut off and the tilt compensator 3 is returned to its middle position by the position valves 62, 62'.

An electric control pulse pushes the change-over valve into an upper position starting from a travel speed of approx. 40 km/h, in which position the two transverse air springs 33, 33' are connected together in an intercommunicating manner directly via a choke diaphragm 53 and thus release the energy store 49, so that the tilt compensator 3 can carry out its action according to the invention.

In both cases, the transverse air springs 33, 33' can be resupplied if necessary, e.g. from the air springs 18, 18' of the carriage body suspension 16 or direct from the supply line of the carriage body 1.

I claim:

1. Device for compensating a tilt of a carriage body of a rail vehicle when travelling around bends at high speeds, comprising:

a passive tilting system, including:

a tilt compensator with a four-bar mechanism, and an energy store means, the tilt compensator being operationally connected to the energy store means to remove parasitic rigidities of the tilt compensator during travel of the device on bends in a superelevated track, the tendency of the carriage body to tilt outside of the bend being compensated, so that a carriage body contour of the vehicle, having an approximate shape of a parallelogram, complies to a predetermined outline profile, the four-bar mechanism including a transversely movable transverse support mounted in a floating manner and supported on a carriage body suspension for providing vertical cushioning for the carriage body, the energy store means including an air spring means displaceable laterally with respect to the carriage body to tilt the carriage body toward an inside of a bend when the carriage body travels around the bend.

2. Device, according to claim 1, wherein the four-bar mechanism coupled to the energy store means produces a tilt of the carriage body towards the inside of the bend, the carriage body being supported on an additional transverse suspension.

3. Device, according to claim 2, wherein the additional transverse suspension comprises additional transverse springs braced with a respective clamping screw and mounted above and below the floating transverse support.

4. Device, according to claim 2, wherein the additional transverse suspension comprises four transverse springs mounted above the floating transverse support.

5. Device, according to claim 1, wherein the four-bar mechanism comprises at least one wobble stabilizer, two laterally mounted, hinged supports coupled at one end, respectively, to the stabilizer and coupled at a second end, respectively, to the transverse support.

6. Device, according to claim 5, wherein the two hinged supports are inclined convergently upwards and are fixed to the transverse support at hinge points in such a manner that, during travel on bends, at least one of the two hinged supports located on an outside of the bend rises and imposes on the transverse support a vertical aligned rotary movement.

7. Device, according to claim 6, wherein the transverse support is mounted in a floating manner between the carriage body suspension and an additional transverse suspension connected to the carriage body and further characterized in that turning out of the carriage body over a bogie associated with the device, due to travel on bends, is absorbed by the additional transverse suspension.

8. Device, according to claim 7, further comprising a resilient transverse stop comprising two transverse buffers with stop faces provided between the carriage body and the floating transverse support.

9. Device, according to claim 1, wherein the transverse support is mounted in a floating manner between a carriage body suspension and an additional transverse suspension connected to the carriage body, and further characterized in that turning out of the carriage body over a bogie, associated with the device, due to travel on bends, is absorbed by the additional transverse suspension.

10. Device, according to claim 9, wherein the additional transverse suspension comprises additional transverse springs braced with a respective clamping screw and mounted above and below a floating transverse support.

11. Device, according to claim 1, wherein the spring means comprises two horizontally mounted transverse air springs, the air springs being mounted opposite one another in pairs between two auxiliary longitudinal supports of a bogie frame associated with the device, and a pivot connected to the transverse support and projecting down from the transverse support and engaging the air springs.

12. Device, according the claim 11, wherein the two transverse air springs are connected together in an intercommunicating manner via a choke diaphragm.

13. Device, according to claim 11, wherein each air spring comprises an outer guide fixed to the pivot, a cone fixed to one of the two auxiliary longitudinal supports of the bogie frame and a rolling bellow which is fixed between the outer guide and the cone.

14. Device for compensating for tilt of a carriage body of a rail vehicle during travel on bends at high speeds by means of a passive tilting system, comprising: a tilt compensator, which during travel on bends in a superelevated track, compensates for thrust of the carriage body to tilt the same towards an outside of the bend, the tilt compensator including a four-bar mechanism including a transversely movable transverse support mounted in a floating manner and supported on a carriage body suspension for providing vertical cushioning for the carriage body, and an air spring means displaceable laterally with respect to the carriage body to tilt the carriage body toward an inside of a bend when the carriage body travels around the bend.

* * * * *